US005544624A

United States Patent [19]

Xiong

[11] Patent Number: 5,544,624

[45] Date of Patent: Aug. 13, 1996

[54] GAS-FIRED, POROUS MATRIX, COMBUSTOR-STEAM GENERATOR

[75] Inventor: Tian-yu Xiong, Darien, Ill.

[73] Assignee: Institute of Gas Technology, Des Plaines, Ill.

[21] Appl. No.: 304,502

[22] Filed: Sep. 12, 1994

Related U.S. Application Data

[63] Continuation-in-part of Ser. No. 90,339, Jul. 12, 1993, Pat. No. 5,375,563.

[51] Int. Cl.[6] ..... F22B 1/00

[52] U.S. Cl. ..... 122/4 D; 110/245

[58] Field of Search ..... 122/4 D; 110/245

[56] References Cited

U.S. PATENT DOCUMENTS

| | | | |
|---|---|---|---|
| 1,331,022 | 2/1920 | Mathy | 158/99 |
| 2,983,259 | 5/1961 | Wittke | 122/4 D |
| 3,188,366 | 6/1965 | Flynn | 263/52 |
| 3,645,237 | 2/1972 | Seth | 122/4 D |
| 3,738,793 | 6/1973 | Reid et al. | 431/328 |
| 3,833,338 | 9/1974 | Badrock | 431/328 |
| 3,877,441 | 4/1975 | Mitch et al. | 122/367.4 |
| 3,921,712 | 11/1975 | Renzi | 122/367.4 |
| 4,354,823 | 10/1982 | Buehl et al. | 126/92 |
| 4,418,650 | 12/1983 | Johnson et al. | 122/4 D |
| 4,499,944 | 2/1985 | Komakine | 165/104.16 |
| 4,597,734 | 7/1986 | McCausland et al. | 431/328 |
| 4,605,369 | 8/1986 | Buehl | 431/328 |
| 4,646,637 | 3/1987 | Cloots | 110/245 |
| 4,666,400 | 5/1987 | Vigneau | 431/328 |
| 4,673,349 | 6/1987 | Abe et al. | 431/328 |
| 4,779,574 | 10/1988 | Nilsson et al. | 122/1 R |
| 4,865,122 | 9/1989 | Brown | 165/104 |
| 4,886,017 | 12/1989 | Viani | 122/4 D |
| 4,899,695 | 2/1990 | Brian et al. | 122/4 D |
| 4,953,512 | 9/1990 | Italiano | 122/4 D |
| 4,966,101 | 10/1990 | Maeda et al. | 122/4 D |
| 5,014,652 | 5/1991 | Hyldgaard | 122/4 D |
| 5,026,269 | 6/1991 | Ruottu | 431/7 |
| 5,054,436 | 10/1991 | Dietz | 122/4 D |

*Primary Examiner*—Noah P. Kamen
*Attorney, Agent, or Firm*—Speckman, Pauley & Fejer

[57] ABSTRACT

A porous matrix, surface combustor-fluid heating apparatus comprising a combustion chamber, a porous stationary bed disposed within the combustion chamber, a porous bed heat exchanger for retaining the porous stationary bed within the combustion chamber, a fuel/oxidant inlet for introducing a fuel/oxidant mixture into the stationary porous bed, a distributor plate for distributing the fuel/oxidant mixture within the stationary porous bed proximate an inlet end of the combustion chamber, and a porous bed heat exchanger comprising at least one vertically oriented, fluid-cooled tube disposed in the stationary porous bed.

13 Claims, 2 Drawing Sheets

GAS-FIRED, POROUS MATRIX, COMBUSTOR-STEAM GENERATOR

CROSS REFERENCE TO RELATED APPLICATION

This is a continuation-in-part patent application to the earlier filed and patent application having U.S. Ser. No. 08/090,339, and filed on Jul. 12, 1993, now U.S. Pat. No. 5,375,563.

BACKGROUND OF THE INVENTION

1. Field of the Invention

This invention relates to a process and apparatus for a porous matrix combustor-fluid heater suitable for use as a steam generator and boiler in which combustion is carried out within the pores of a stationary porous bed and heat transfer is achieved using heat exchange surfaces vertically embedded in the stationary porous bed resulting in secure circulation of steam/water mixtures in the evaporating tubes and excellent performance including very high combustion intensity, very high heat transfer rates, improved energy utilization efficiency, and ultra-low combustion emissions, as well as lower capital and operating costs.

2. Description of the Prior Art

In general, heat energy may be transmitted by conduction, convection and/or radiation. Heat transmission by radiation and utilization of infrared energy has many advantages over conventional heat transmission by convection and conduction. The operation and construction of infrared burners and radiant heaters is relatively simple, and thus more economical than other types of heat generation means. The intensity of radiant heat may be precisely controlled for greater efficiency and infrared energy may be focused, reflected, or polarized in accordance with the laws of optics. In addition, radiant heat is not ordinarily affected by air currents. One type of gas-fired infrared generator currently available is a surface combustion infrared burner having a radiating burner surface comprising a porous refractory. The combustion mixture is conveyed through the porous refractory and burns above the surface to heat the surface by conduction. One such burner is taught by U.S. Pat. No. 1,331,022. Other surface combustors are taught by U.S. Pat. Nos. 4,666,400, 4,605,369, 4,354,823, 3,188,366, 4,673,349, 3,833,338, and 4,597,734. See also U.S. Pat. No. 3,738,793 which teaches an illumination burner having a layered porous structure, the layered pores maintaining a stable flame in a thoria-ceria illumination burner in which combustion occurs not within the pores of the combustor, but rather on the surface of the top layer.

Control of combustion emissions, in particular $NO_x$ emissions, is an important requirement for surface combustors which are generally known to produce high combustion intensity and, thus, high combustion temperatures. It is generally known that to reduce $NO_x$ formation within the combustion process, it is necessary to simultaneously remove heat from the combustion process as combustion of the fuel occurs. U.S. Pat. No. 5,014,652 teaches a fluidized bed combustion reactor/fluidized bed cooler comprising a vertical reactor chamber designed to contain two separate fluidized beds, one of which contains cooling coils through which a cooling fluid is flowing to remove heat from the bed. U.S. Pat. No. 3,645,237 teaches a fluidized bed water heater in which water is heated or steam is produced by passing water through heating coils embedded in the fluidized bed. Similarly, U.S. Pat. No. 4,499,944, U.S. Pat. No. 4,779,574, and U.S. Pat. No. 4,646,637 teach a heat exchanger installed in a fluidized bed.

U.S. Pat. No. 4,966,101 teaches a fluidized bed combustion apparatus having a plurality of catalyst tubes filled with catalysts for reforming hydrocarbon gas into steam and arranged in both a horizontal and vertical direction both in and above a fluidized bed in a fluidizing chamber. U.S. Pat. No. 4,899,695 teaches a fluidized bed combustion reaction in which heat is transferred from the fluidized bed to water-containing tubes surrounding the reactor.

U.S. Pat. No. 4,865,122 teaches a fluidized bed heat exchanger for enhanced heat transfer between two liquids having different heat content in which a first liquid is directed through a shell enclosure containing a bed material supported on a distribution plate, the pressure of the liquid controlling the level of fluidization of the bed material, and a second liquid is directed through tubes positioned in the bed material, each of which tube containers includes bed materials supported on a distribution plate. The second liquid is provided at sufficient pressure through the tube containers to fluidize the bed material therein.

U.S. Pat. No. 5,054,436 teaches a recycle bubbling bed formed integrally with a furnace which functions as a heat exchanger and a combustor in which flue gases and entrained particulate materials from a circulating fluidized bed in the furnace are separated, the flue gases are passed to a heat recovery area while the separated solids are passed to the recycle bubbling fluidized bed, and heat exchange surfaces are provided in the recycle bubbling bed to adsorb combustion heat and the solids' sensible heat, and a bypass compartment is provided in another compartment of the recycle bubbling bed through which the solids directly pass to a circulating bed in the furnace during start-up and low load conditions.

U.S. Pat. No. 5,026,269 teaches a nozzle bottom comprising a plurality of fluidizing nozzles for introducing fluidizing air into the reactor chamber of a fluidized bed reactor.

One problem associated with fluidized bed combustors is the amount of particulate matter generated by such beds which is carried out with the products of combustion exhausted by the combustor. In addition, the abrasiveness of the fluidized bed particles against the outer surfaces of heat exchangers disposed in the fluidized bed causes erosion of the heat exchanger surfaces. Finally, pressure drop of flow through the fluidized bed is high due to the high flow velocity required for fluidization.

SUMMARY OF THE INVENTION

It is an object of this invention to provide a process and apparatus for gas fired combustion and fluid heating which produces ultra-low combustion emissions.

It is another object of this invention to provide a process and apparatus for gas fired combustion and fluid heating having higher combustion intensity, high heat transfer rates, and, thus, higher energy utilization efficiency than known gas fired combustion and fluid heating devices.

It is yet another object of this invention to provide a process and apparatus for gas fired combustion and fluid heating suitable for use in steam generation and boiler applications.

These and other objects of this invention are achieved by a porous matrix, surface combustor-fluid heating apparatus comprising at least one combustor wall which forms a combustion chamber having an inlet end and an outlet end, a stationary porous bed disposed within the combustion chamber, means for introducing a fuel/oxidant mixture into the stationary porous bed, retention means for retaining the stationary porous bed within the combustion chamber, distribution means for distributing the fuel/oxidant mixture within the stationary porous bed proximate the inlet end of the combustion chamber, and porous bed heat exchanger means comprising at least one vertically oriented, fluid-cooled tube disposed within the stationary porous bed.

The porous matrix, surface combustor-fluid heater in accordance with this invention is a combined combustion and heat transfer device in which the heat exchange surfaces are embedded in a stationary porous bed in which a gaseous fuel is burned. Because fuel combustion takes place in a great number of the small pores in the porous media, combustion intensity is very high and quenching of the combustion reaction by the cool heat exchange surfaces is eliminated. The overall heat transfer from the products of combustion to the load is significantly enhanced because of the intense combined heat convection and radiation. Removing heat simultaneously as combustion of the gaseous fuel occurs results in a reduction of $NO_x$ formation.

In accordance with this invention, the combustion density achieved is more than 10 times higher than conventional gas burners. The overall heat transfer rate is more than 5 times higher than conventional commercially available thermal fluid heaters. And, nitrogen oxides and carbon monoxide emissions are as low as 15 parts per million in volume (corrected to 0% oxygen), a reduction of about 75% compared to conventional gas burners.

In accordance with one embodiment of this invention suitable for use as a steam generator and/or boiler, the heat exchange tubes are vertically placed within the porous matrix bed to secure effective circulation of steam/water flow in the tubes resulting in protection of the tube materials from overheating at the very high heat transfer intensities achieved by this invention, and a combustion intensity about ten (10) times higher than that achieved by conventional gas-fired boilers. In addition, the total amount of heat transfer surfaces required to achieve approximately the same overall thermal efficiency as conventional gas-fired boilers can be reduced by about 25% to about 50% compared to the heat transfer surfaces in conventional gas-fired boilers. As a result, boilers utilizing the process and apparatus of this invention are substantially more compact than conventional boilers and can be fabricated at a substantially lower cost than conventional boilers.

BRIEF DESCRIPTION OF THE DRAWINGS

These and other features of this invention will be better understood from the following detailed description taken in conjunction with the drawings wherein.

DESCRIPTION OF PREFERRED EMBODIMENTS

Figure 1:
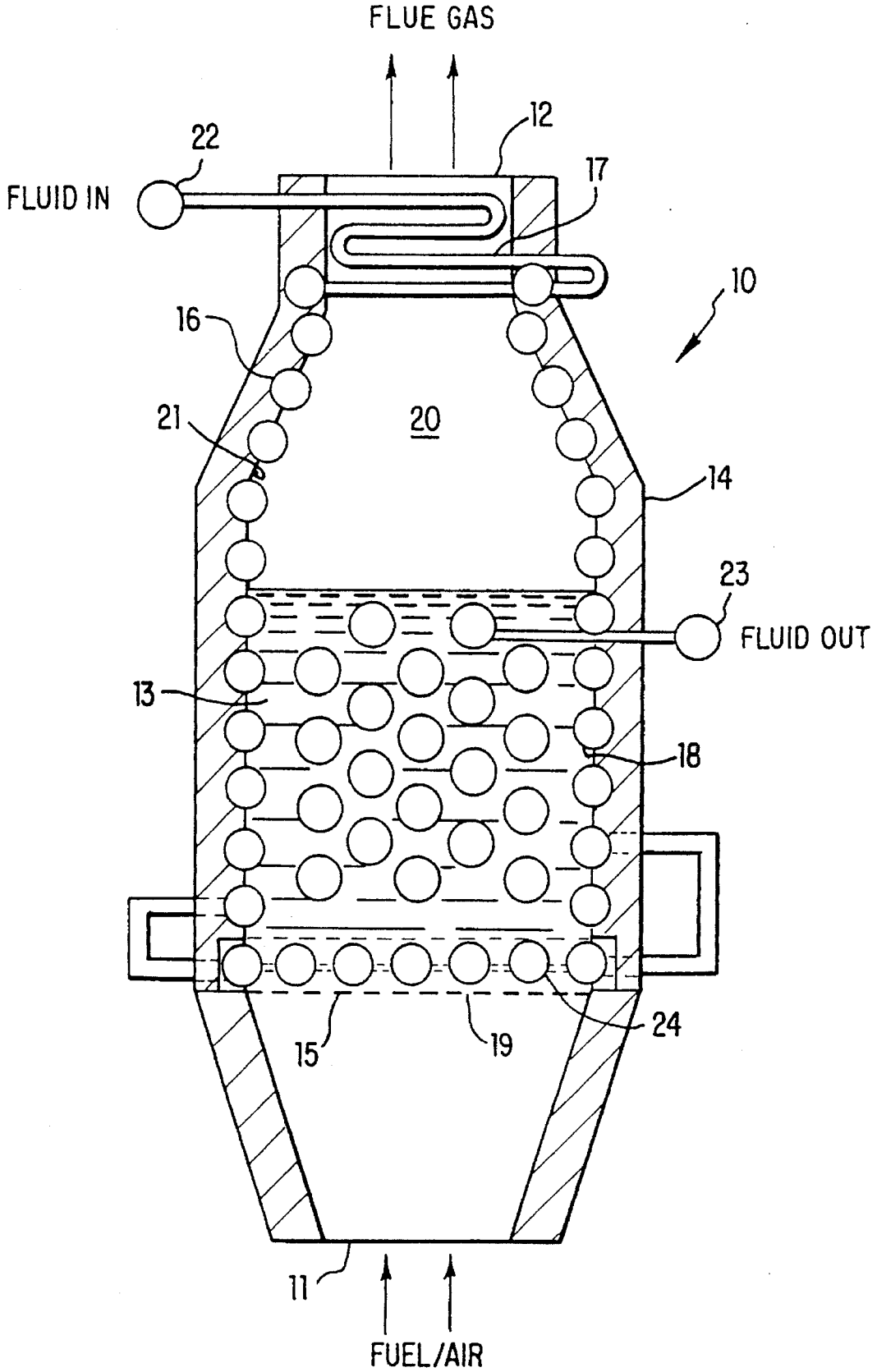
FIG. 1 shows a cross-sectional side view of a gas-fired, porous matrix, surface combustor-fluid heater in accordance with one embodiment of this invention.

In accordance with one embodiment of this invention as shown in FIG. 1, the gas-fired, porous matrix, surface combustor-fluid heater of this invention comprises at least one combustor wall 14 forming combustion chamber 20 having inlet end 11 and outlet end 12. Proximate inlet end 11 of combustion chamber 20 is cooled flow distributor 15 having openings 19 through which fuel and air introduced into inlet end 11 flow into combustion chamber 20. Cooled flow distributor 15 supports stationary porous bed 13 within combustion chamber 20. Embedded in stationary porous bed 13 is porous bed heat exchanger means 18 in the form of a plurality of rows of fluid cooled tubes. In accordance with a preferred embodiment of this invention, the row of fluid-cooled tubes 18 nearest cooled flow distributor 15 is disposed between about 1.0 and about 4.0 inches from cooled flow distributor 15.

Surface combustor fluid heating apparatus 10 further comprises combustion wall heat exchanger means disposed on interior surface 21 of combustor wall 14 and in outlet end 12 of combustion chamber 20. In accordance with one embodiment of this invention, said combustor wall heat exchanger means comprises at least one tube coil 16 disposed on interior surface 21 of combustor wall and at least one tube coil 17 in outlet end 12 of combustion chamber 20. In accordance with a preferred embodiment of this invention, tube coil 16 disposed on interior surface 21 of combustor wall 14 and tube coil 17 disposed in outlet end 12 of combustion chamber 20 are in communication with one another such that cooling fluid is introduced into tube coil 17 through fluid inlet 22 and then flows through tube coil 16 disposed on interior surface 21 of combustor wall 14. In accordance with yet another embodiment of this invention, tube coil 16 disposed on interior surface 21 of combustor wall 14 is in communication with said plurality of rows of fluid cooled tubes 18 disposed in stationary porous bed 13 such that cooling fluid flowing through tube coil 16 subsequently flows through fluid cooled tubes 18 after which it exits through fluid outlet 23. The heated fluid is then communicated to any number of applications requiring a heated fluid, such as a water heater.

Cooled flow distributor 15, in accordance with one embodiment of this invention, comprises a wall having a plurality of openings 19 through which a fuel/oxidant mixture flows into stationary porous bed 13. To provide cooling to cooled flow distributor 15, at least one distributor fluid cooled tube is disposed within cooled flow distributor 15. In a particularly preferred embodiment of this invention, said cooled flow distributor wall 15 is in the form of a membrane wall.

To provide the desired heat exchange between stationary porous bed 13 and fluid cooled tube 18 disposed in stationary porous bed 13, it is preferred that the outside diameter of fluid cooled tube 18 be between about 0.5 to about 3.0 inches. In addition, the ratio of tube spacing within stationary porous bed 13 (horizontally and vertically) to the diameter of fluid cooled tubes 18 is preferably between about 1.5 to about 3.0.

Stationary porous bed 13 comprises a plurality of high temperature ceramic particles, preferably selected from the group consisting of alumina, silicon carbide, zirconia, and mixtures thereof. The mean diameter of said ceramic particles is between about 0.1 and about 1.0 inches.

Figure 2:
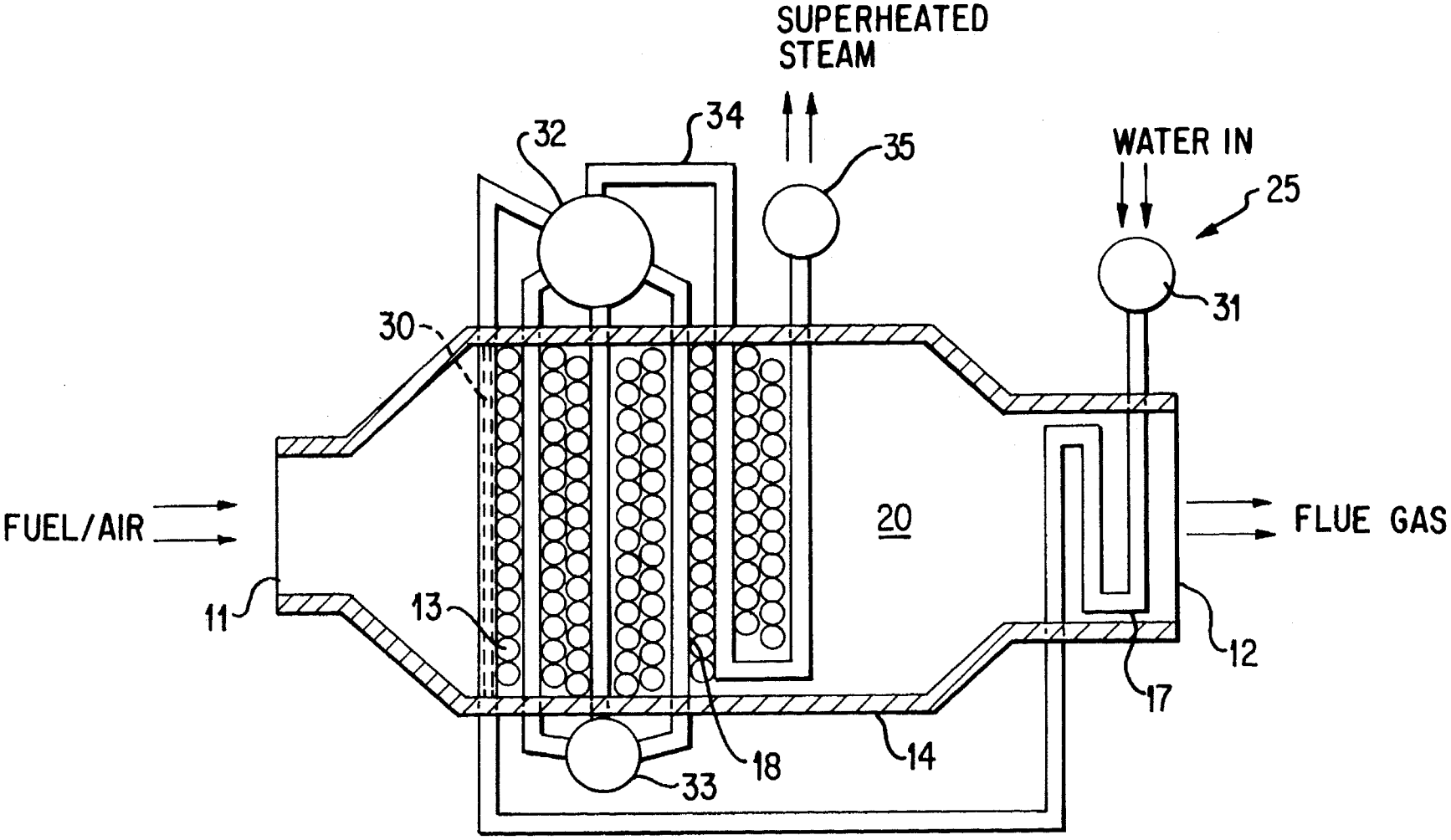
FIG. 2 shows a cross-sectional side view of a gas-fired, porous matrix, surface combustor-fluid heater suitable for use as a boiler in accordance with one embodiment of this invention.

FIG. 2 shows a porous matrix, surface combustor-fluid heating apparatus 25 in accordance with one preferred embodiment which is suitable for use as a boiler. The critical element of this embodiment is the disposition of the tubes 18 within stationary porous bed 13. In particular, tubes 18 are oriented vertically within stationary porous bed 13 to allow natural circulation, the essential draft force in a boiler, of the fluids, that is water, steam and water/steam mixtures, in the tubes. Utilization of horizontal tubes 18 as shown in FIG. 1 would result in separation of steam and water, resulting in a significant increase in wall temperature in the top region of the tubes which can cause serious problems including overheating, erosion, and unstable fluid flow within the tubes.

To provide substantially even distribution of the fuel/oxidant mixture within stationary porous bed 13, the porous matrix, surface combustor-fluid heater apparatus in accordance with the embodiment shown in FIG. 2 further comprises distribution means in the form of a wall 30 having a plurality of openings through which the fuel/oxidant mixture flows into stationary porous bed 13. In accordance with one embodiment of this invention, wall 30 is in the form of fins secured on the outer surfaces of a first row of tubes, or inserted between the tubes, the fins forming openings through which the fuel/oxidant mixture flows into stationary porous bed 13. In addition, in accordance with another embodiment of this invention, wall 30, in addition to providing distribution of the fuel oxidant mixture within stationary porous bed 13, also enables retention of stationary porous bed 13 within combustion chamber 20 by preventing the ceramic particles comprising stationary porous bed 13 from flowing into the inlet region 11 of the apparatus.

In accordance with one embodiment of this invention, tubes 18 are arranged in the inlet region of combustion chamber 20 and the outlet region of combustion chamber 20 in such a manner whereby the high temperature ceramic particles forming stationary porous bed 13 are maintained within combustion chamber 20. In particular, in accordance with one embodiment of this invention, in the inlet region 11 of combustion chamber 20, some of tubes 18 are embedded within a membrane wall which acts as a distributor of the fuel/oxidant mixture, thereby constituting an inlet distribution grate, as in the embodiment shown in FIG. 1. Similarly, some of tubes 18 disposed in the outlet region of combustion chamber 20 form an outlet grate through which flue gases from the combustion process are discharged from stationary porous bed 13 while preventing the ceramic particles comprising stationary porous bed 13 from being carried out of combustion chamber 20. Thus, stationary porous bed 13 is disposed between the inlet grate and the outlet grate formed by tubes 18, thereby retaining stationary porous bed 13 within combustion chamber 20.

As with the embodiment shown in FIG. 1, the outside diameter of tubes 18 is preferably between about 0.5 and about 3.0 inches. In addition, in accordance with one preferred embodiment of this invention, the tubes 18 nearest wall 30 which functions as a distributor of the fuel/oxidant mixture within stationary porous bed 13 are disposed between about 1.0 and about 4.0 inches from wall 30.

In accordance with the embodiment shown in FIG. 2, feedwater 31 entering apparatus 25 is first heated in an economizer section in the form of tube coil 17 disposed in outlet end or flue gas connection duct 12 of combustion chamber 20. Hot water from the economizer section is circulated to the upper steam drum 32 disposed proximate the top of apparatus 25. Fluid cooled tubes 18 connected between upper steam drum 32 and lower steam drum 33 disposed proximate the bottom of apparatus 25 in which water is evaporated and the resulting water/steam mixture is circulated are embedded within stationary porous bed 13. Saturated steam separates from the water/steam mixture in upper steam drum 32 and enters superheater tubes 34, also disposed within stationary porous bed 13, to raise its temperature. The superheated steam exits apparatus 25 through a collection drum 35.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of the invention.

We claim:

1. A porous matrix, surface combustor-fluid heating apparatus comprising:

at least one combustor wall forming a combustion chamber, said combustion chamber having an inlet end and an outlet end;

a stationary porous bed disposed within said combustion chamber;

retention means for retaining said stationary porous bed within said combustion chamber:

means for introducing a fuel/oxidant mixture into said stationary porous bed;

distribution means for distributing said fuel/oxidant mixture within said stationary porous bed proximate said inlet end of said combustion chamber, said distribution means comprising a wall having a plurality of openings through which said fuel/oxidant mixture flows into said stationary porous bed and at least one fluid-cooled tube disposed within said wall; and porous bed heat exchanger means comprising at least one vertically oriented, fluid-cooled tube disposed in said stationary porous bed.

2. A porous matrix, surface combustor-fluid heating apparatus in accordance with claim 1 further comprising combustor wall heat exchanger means disposed on the interior surface of said combustor wall.

3. A porous matrix, surface combustor-fluid heating apparatus in accordance with claim 1, wherein said porous bed heat exchanger means comprises at least one said vertically-oriented, fluid-cooled tube disposed in an outlet region of said combustion chamber.

4. A porous matrix, surface combustor-fluid heating apparatus in accordance with claim 1, wherein said stationary porous bed comprises a plurality of high-temperature ceramic particles.

5. A porous matrix, surface combustor-fluid heating apparatus in accordance with claim 4, wherein said particles have a mean diameter in the range of about 0.1 to 1.0 inches.

6. A porous matrix, surface combustor-fluid heating apparatus in accordance with claim 4, wherein said high-temperature ceramic particles are selected from the group consisting of alumina, silicon carbide, zirconia and mixtures thereof.

7. A porous matrix, surface combustor-fluid heating apparatus in accordance with claim 1, wherein said distribution means comprises a wall having a plurality of openings through which said fuel/oxidant mixture flows into said stationary porous bed.

8. A porous matrix, surface combustor-fluid heating apparatus in accordance with claim 5, wherein said wall is a membrane wall.

9. A porous matrix, surface combustor-fluid heating apparatus in accordance with claim 1, wherein said retention means comprises said porous bed heat exchanger means disposed in a fuel/oxidant mixture inlet region of said porous stationary bed and in a flue gas outlet region of said porous stationary bed.

10. A porous matrix, surface combustor-fluid heating apparatus in accordance with claim 1, wherein said wall is a membrane wall.

11. A porous matrix, surface combustor-fluid heating apparatus in accordance with claim 1, wherein the outside diameter of said fluid-cooled tube is in the range of about 0.5 to 3.0 inches.

12. A porous matrix, surface combustor-fluid heating apparatus in accordance with claim 1, wherein said at least one vertically oriented-fluid cooled tube is disposed at least in the range of about 1.0 to 4.0 inches from said distribution means.

13. A porous matrix, surface combustor-fluid heating apparatus in accordance with claim 1, wherein said porous bed heat exchanger means comprises a plurality of rows of said vertically oriented, fluid-cooled tubes disposed in said stationary porous bed, the row nearest said distribution means being disposed in the range of about 1.0 to 4.0 inches from said distribution means.

* * * * *